US007905759B1

(12) United States Patent
Ghaly

(10) Patent No.: US 7,905,759 B1
(45) Date of Patent: Mar. 15, 2011

(54) INTERACTIVE PLAY SET

(76) Inventor: Nabil N. Ghaly, South Huntington, NY (US)

( * ) Notice: Subject to any disclaimer, the term of this patent is extended or adjusted under 35 U.S.C. 154(b) by 0 days.

(21) Appl. No.: 10/958,879

(22) Filed: Oct. 6, 2004

Related U.S. Application Data

(60) Provisional application No. 60/508,907, filed on Oct. 7, 2003.

(51) Int. Cl.
*A63H 30/00* (2006.01)

(52) U.S. Cl. ..... 446/175; 446/456; 446/436; 446/268; 446/297

(58) Field of Classification Search ..... 446/297, 446/298, 175, 436, 454, 456, 97, 268
See application file for complete search history.

(56) References Cited

U.S. PATENT DOCUMENTS 4,712,184 A * 12/1987 Haugerud ..... 446/454
4,820,233 A * 4/1989 Weiner ..... 446/175
6,171,168 B1 * 1/2001 Jessop ..... 446/297
6,227,931 B1 * 5/2001 Shackelford ..... 446/268
6,315,630 B1 * 11/2001 Yamasaki ..... 446/275
6,443,796 B1 * 9/2002 Shackelford ..... 446/91
6,554,679 B1 * 4/2003 Shackelford et al. ..... 446/268
6,609,943 B1 * 8/2003 Chan ..... 446/297
6,648,719 B2 * 11/2003 Chan ..... 446/297

* cited by examiner

*Primary Examiner* — Gene Kim
*Assistant Examiner* — Urszula M Cegielnik

(57) ABSTRACT

An interactive play set, method and apparatus, is disclosed which is based on a host toy and a plurality of action figures. Each of the action figures has a unique set of attributes related to how the action figure interacts with the host toy device. The play set includes communication means to transmit the identity of the action figure to the host toy, and/or to transmit commands from the host toy to the action figure. The preferred embodiment discloses a remote control toy car, and a plurality of action figures that represent drivers. Associated with each action figure is one or a plurality of motion profiles that are stored in the memory of the car device. Upon connecting an action figure to the car device, the microprocessor of the car device will select and execute a motion profile corresponding to the action figure. The car toy device has a remote control apparatus to enable a player to interact with it. An alternate embodiment discloses a host toy device in the form of a doll, and a plurality of action figures in the form of pet animals. Upon connecting an action figure to the doll device, a set of interactions unique to said action figure are executed.

28 Claims, 15 Drawing Sheets

IDENTIFICATION CHART

| ACTION FIGURE | PIN CONFIGURATION | BINARY ID | DRIVING HABITS/ ATTRIBUTES |
|---|---|---|---|
| ALAN | B 3 1 2 | 001 | ❖ Follows instructions<br>❖ Courteous<br>❖ Likes night driving |
| ERIC | B 3 1 2 | 010 | ❖ Aggressive<br>❖ Talks to vehicle<br>❖ Experimental |
| MARY | B 3 1 2 | 011 | ❖ Cautious<br>❖ Excessive use of horn<br>❖ Hard brake application |
| MARK | B 3 1 2 | 100 | ❖ Drives in circles<br>❖ Does not follow instructions<br>❖ Misses turns & stops |
| JESSICA | B 3 1 2 | 101 | ❖ Drives at high speed<br>❖ Flashes headlights<br>❖ Uses horn as a musical instrument |
| CHRISTINA | B 3 1 2 | 110 | ❖ Slow driving<br>❖ Forgets to signal before turns<br>❖ Cannot control reverse driving |
| JOHN | B 3 1 2 | 111 | ❖ Brakes at last minute<br>❖ Drives with headlights "ON"<br>❖ Gets lost easily |

Figure – 11 -

INTERACTIVE PLAY SET

This utility application benefits from provisional application of U.S. Ser. No. 60/508,907, filed on Oct. 7, 2003.

BACKGROUND OF THE INVENTION

Toy action figures are becoming increasingly popular, and are normally miniature figures having a configuration and visual appearance which represent a person, an animal or thing of an exciting nature, such as comic or movie characters, national heroes, science fiction personalities, celebrities or the like. Current action figures include articulated parts, and in the case of a human figure, articulated body parts such as arms, legs, head etc. Examples of toy action figures are shown in U.S. Pat. No. 4,802,879 (Rissman et al.), and U.S. Pat. No. 4,723,931 (Allen et al).

An action figure is normally associated with a number of toy devices and accessories to provide a plurality of playing sets, which may be unique to the action figure. A player normally uses his or her imagination to interact the action figure with a playing set in a plurality of playing activities. Such playing activities are usually influenced by the player's perception of the background and personality profile of the action figure. U.S. Pat. No. 5,073,140 (Lebensfeld et al.) discloses toy action figures and detachable accessories, which incorporate audio generating apparatus.

To the knowledge of the inventor, there are no action figures, available in the market place, which can directly control or affect the operation of another toy apparatus to provide predetermined playing activities. An example of a toy apparatus which operation can be affected by interactive action figures is a remote control toy car. An action play set to modify the functionality of this remote control toy car depicts a child as an auto driver instructor, and a plurality of action figures as student drivers. Such an action play set will provide the child with hours of enjoyment through the interaction of the action figures with the toy car apparatus.

OBJECT OF THE INVENTION

This invention relates to toys and in particular to action figures that interact with other toy and game devices to provide a broad spectrum of educational, fun related and entertaining activities. Unlike most action figures, which are based on fairy tales and fictitious characters, one object of this invention is to provide action figures that represent typical neighborhood kids, and which can be personalized by the child based on his or her imagination and/or associations.

It is also an object of this invention to make action figures interactive by incorporating electrical and/or electronic devices and components that provide a unique identity to each action figure.

It is another object of this invention to provide action figures that can interact directly with other toy and game devices to control or affect the operation of said devices in a predetermined manner.

It is also an object of this invention to provide a plurality of action figures, each of which comprises electrical and/or electronic components capable of storing alphanumeric and/or binary information to fully describe associated personality attributes of the action figure or, in the alternative, capable of storing a unique code. Such unique code can be used by a host toy to access information related to the personality attributes of the action figure, and stored in the memory of the host toy.

It is another object of this invention to provide a plurality of action figures, each of which comprises either wire or wireless interfaces to communicate the attributes and personality traits of said action figures, or the unique identification codes, to other game and toy apparatus, and to interact with these apparatus by controlling their functionality and operations in a predetermined manner.

It is another object of this invention to provide a plurality of interactive action figures, which can be used interchangeably with different toy apparatus.

It is yet another object of the invention to provide an action figure that can be programmed by the child into a plurality of different personalities, and which can interact with other toy or game devices to control or affect the operation of said devices.

It is another object of this invention to provide an example of a toy apparatus which functionality and operation can be controlled and/or affected by a plurality of action figures.

It is still an object of the current invention to provide a play set that consists of a remote controlled vehicle, and a plurality of action figures, each of which interacts with the vehicle in accordance with a predetermined motion profile.

It is a further object of this invention to provide a remote controlled vehicle with provisions for external plug in memory to store data for additional action figures and/or motion profiles.

It is also an object of this invention to provide an alternate embodiment that consists of a doll device that interacts with a plurality of action figures in the form of pet animals.

It is another object of the invention to achieve the above objectives in an economical and easy to implement fashion.

SUMMARY OF THE INVENTION

The foregoing and other objects of the invention are achieved in accordance with one preferred embodiment of the invention by providing a plurality of action figures each of which comprises electrical and/or electronic components capable of storing information that uniquely identifies the action figure. The stored information can also include the personality attributes of the action figure. Alternatively, such personality attributes can be stored in the host toy device. Further, each action figure includes wire or wireless interfaces to communicate with host toy devices. Such electrical components and interfaces are contained on or within the action figure.

According to an embodiment of the invention, the visual appearance, costume and other characteristic of a toy action figure is coordinated with its personality profile, or personality attributes, stored either within the action figure, or in a host toy device. In one preferred embodiment, a plurality of action figures depicting teenage boys and girls are provided. Each action figure includes passive wiring, and a four (4) pin connectors to provide a unique binary identity to the action figure. The connector also provides a wire interface to identify the action figure to a host toy apparatus. There is no source of electrical power inside the action figure. The action figure receives electrical energy via one of the four pins, identified as the battery pin, from the host toy apparatus. The battery pin in turns energizes the appropriate pin(s) that define the identity of the action figure. This preferred embodiment provides for seven (7) different binary identities. The personality attributes of each action figure are stored in the host toy device, and are associated with the action figure using the unique binary identifier. For the preferred embodiment, the personality attributes includes data on how each action figure interacts with the host toy apparatus. Such data could be explicit, or implied by the actions of the host toy apparatus. Also the personality profile of each action figure is coordinated with its visual appearance, costume and other physical characteristics. An alternate embodiment provides a plurality of action figures each of which includes a programmable memory device, which can store alphanumeric information such as a name, gender, birth date, personality attributes, habits or attributes related to the host toy, and the like.

The host toy described in the preferred embodiment consists of a remote control car having speed, directional, and steering controls. These controls are provided on a remote control apparatus, and can be used by a player to operate the toy car similar to traditional remote control car devices. The remote control apparatus, also, includes a control switch having two positions identified as "student" and "instructor." Further, the toy vehicle comprises a microprocessor that controls the operation of the vehicle, and includes a Read Only Memory (ROM) that stores a plurality of motion profiles, each of which corresponds to an action figure, and constitutes a part of the personality attributes of the associated action figure. Additional motion profiles can be provided through the use of a plug in memory device such as flash memory.

When the control switch is set to the "instructor" position, the speed, directional and steering functions on the remote control apparatus are enabled, and the player can use these controls to provide directional, speed and steering commands to the microprocessor in order to operate the toy vehicle. Alternatively, when the control switch is set to the "student" position, the microprocessor uses one of the plurality of stored motion profiles to control the operation of the vehicle. Upon connecting an action figure to a seatbelt connector, the microprocessor will first ascertain the identity of the action figure, and will then fetch the corresponding motion proffie data from its memory. A set of motion profile data consists of a series of motion commands, each of which includes directional, speed, or steering signals. These signals are generated as a function of time using the point in time when a proceed signal is given by the player as the start or origin of the motion profile. A motion profile may consist of repeated simple patterns of movements, such as circles, squares, figure eights, or may consist of a series of movements, including forward and reverse driving, in combination with left and right turns. The main attributes of a motion profile includes the direction of motion (forward or reverse), speed of motion, rate of acceleration, rate of deceleration (stop actions), predetermined or random turns, and sound and visual effects such as blowing the horn, activating headlights, emergency lights, or turn signals. A motion profile may also include one or a plurality of verbal communications that are personalized to the action figure.

As an optional feature, a motion profile for a particular action figure can be established by the player, using the controls on the remote control apparatus (with the control switch set to the "instructor" position), and then stored in the memory of the host toy (remote control toy) using an additional store function.

BRIEF DESCRIPTION OF THE DRAWINGS

These and other more detailed and specific objectives will be disclosed in the course of the following description taken in conjunction with the accompanying drawings wherein:

FIG. 3 is a tabulation of electrical jumper configuration, the binary identification number, and sample driving attributes associated with each of seven action figures.

FIG. 11 is a tabulation indicating the various action figures, associated electrical connections, binary identifications, and driving habits or attributes.

DESCRIPTION OF THE PREFERRED EMBODIMENT

Figure 1:
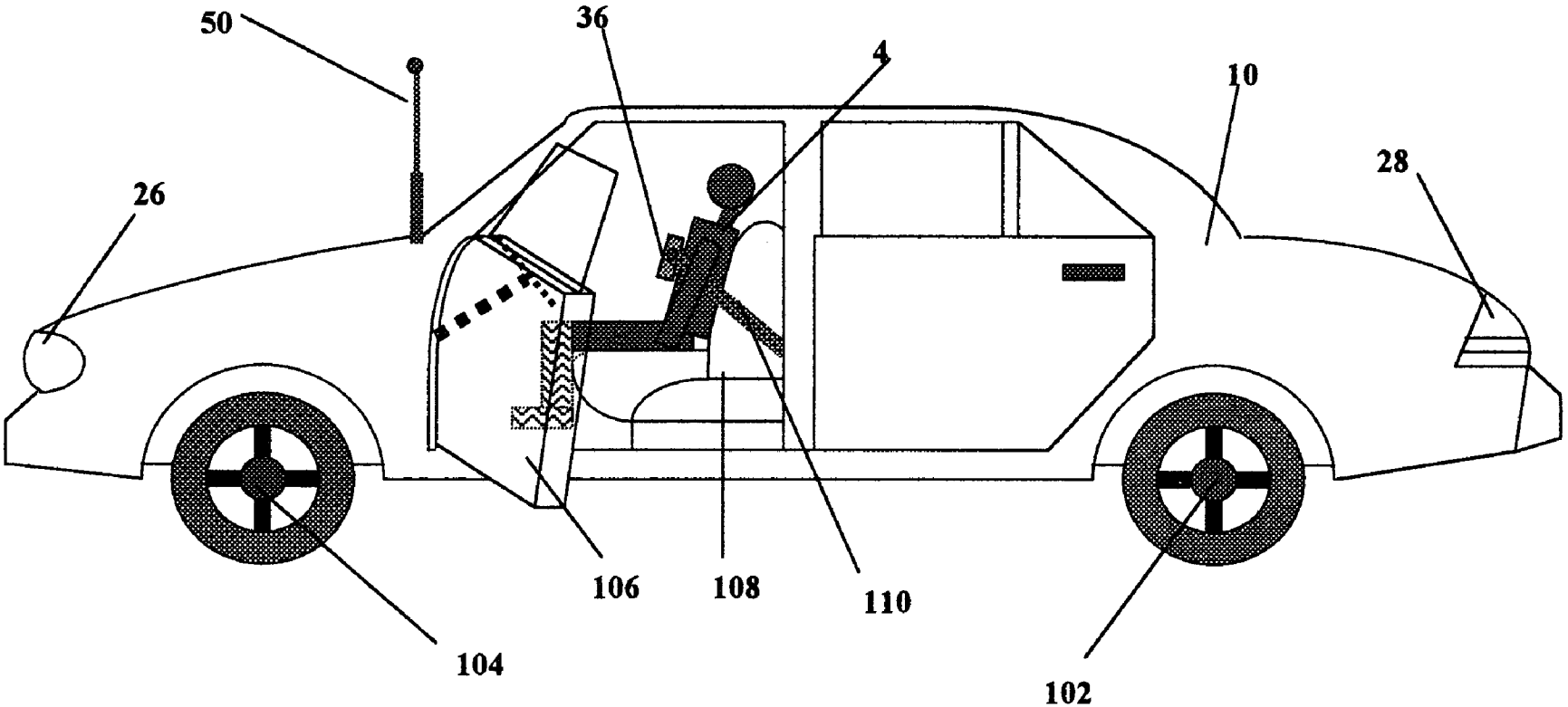
FIG. 1 is a view of the preferred embodiment of a remote control toy car showing an action figure attached to a seatbelt connector according to the invention.
Figure 2:
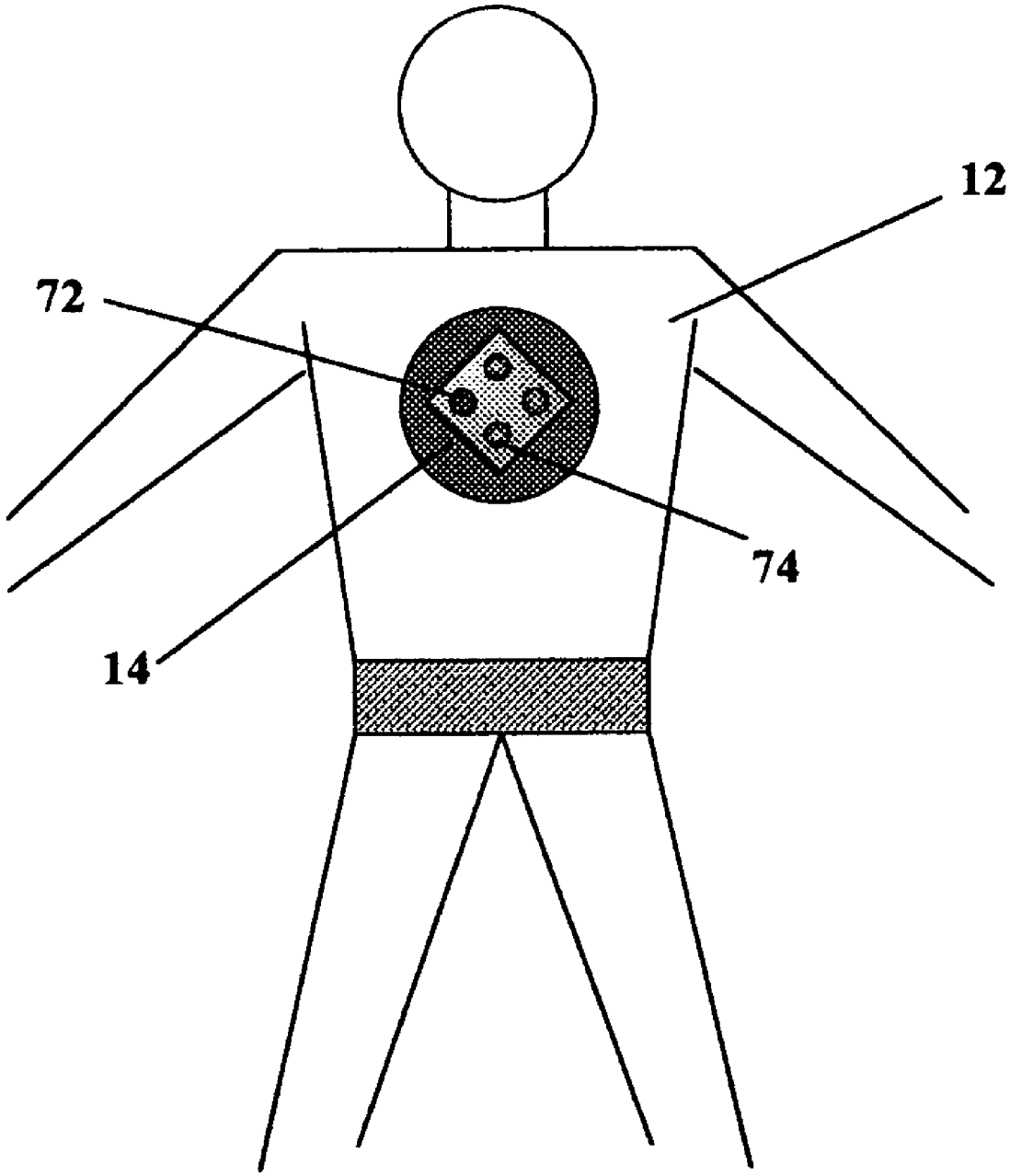
FIG. 2 is a diagram showing an action figure with an electrical male connector having four pins.
Figure 5:
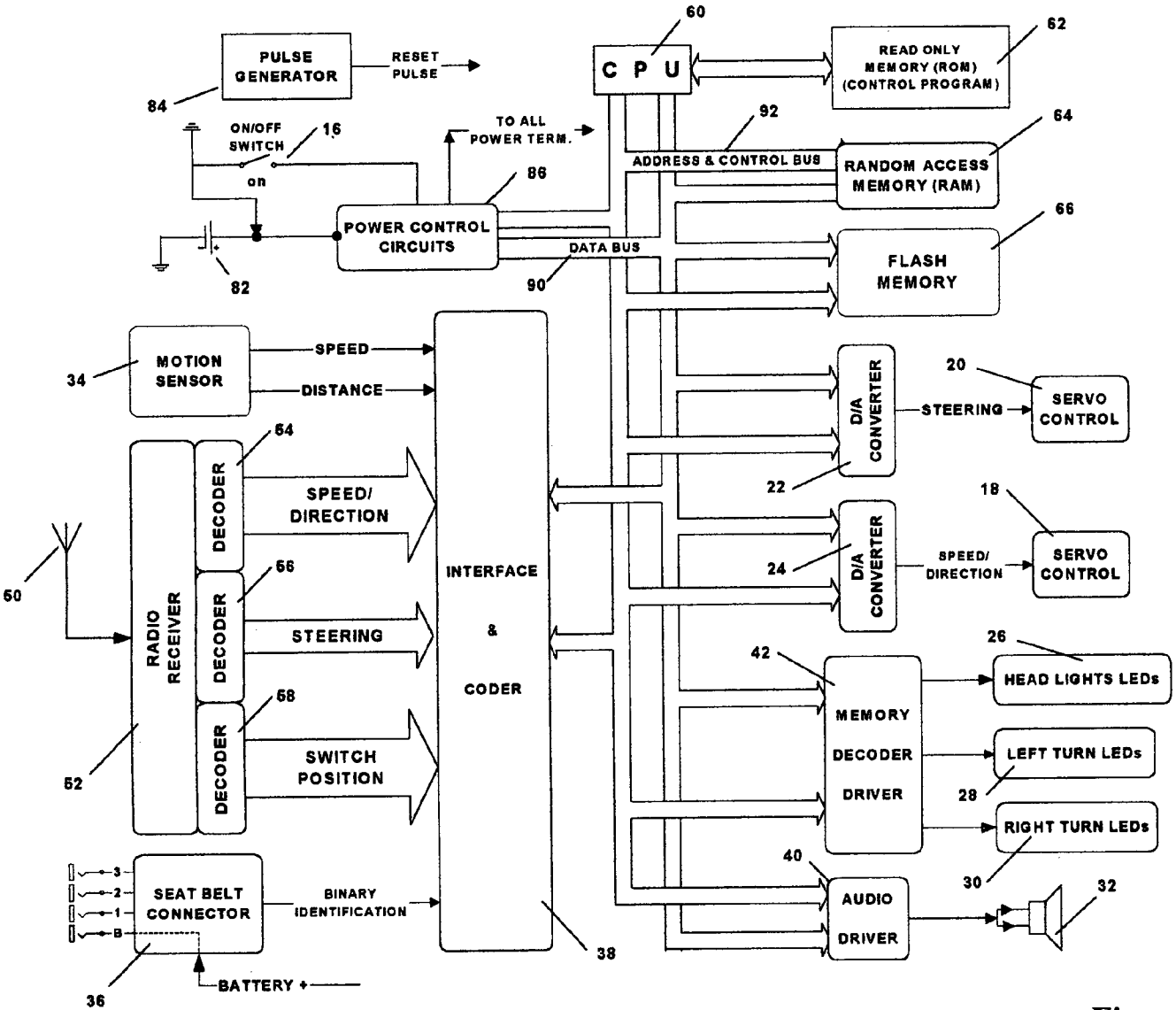
FIG. 5 is a block diagram of the microprocessor circuitry used to control the remote control toy vehicle according to the invention.

Referring now to the drawings where the illustrations are for the purpose of describing the preferred embodiment of the invention and are not intended to limit the invention hereto, FIG. 1 is a view of a remote control toy car 10 comprising a car body with a chassis having two axles 102 & 104. The rear axle 102 is coupled to an electric motor (not shown), which is connected to a servo mechanism 18 (shown in FIG. 5) that controls the direction of rotation and speed of the motor. The front axle 104 is connected to a steering mechanism, controlled by a servo mechanism 20 (shown in FIG. 5), which enables the toy car to turn to the left, or to the right. In turn, the servo mechanisms 18 & 20, shown in FIG. 5, are connected to digital to analog (D/A) converters 22 & 24 to interface the servo mechanisms with the microprocessor. Preferably, the toy car would include front and rear seats 108, operating doors 106, operating headlights 26, and operating turn signal lights 28 & 30. The operating headlights 26, and turn signal lights 28 will also provide braking indication, as well as emergency flashing indication. The operation of the toy car device is controlled by a microprocessor having a central processing unit (CPU) 60, an internal read only memory (ROM) 62, a random access memory (RAM) 64, and an optional external plug-in flash memory 66. The functions of the toy car are provided by a control program that resides in ROM 64, and which receives input commands from the remote control apparatus via the communication receiver module 52, and associated decoders 54, 56 & 58. The optional flash memory 66 is used to provide additional motion profiles, and can also be used to store motion profiles created by the player during game play, as well as personality attributes for additional action figures. The microprocessor interfaces with the driving motor, the steering mechanism for the car, the headlights 26, the turn signal lights 28 & 30, and a speaker 32 that generates verbal messages, and audible indications such as engine, horn, and braking sound effects. The microprocessor also interfaces with a motion odometer, or sensor, 34, which measures actual distance traveled and actual speed of the car device. The distance and speed information is fed to the microprocessor, and is used to derive certain events, or to trigger over speed alarm indications during certain motion profiles. Additional sensors can also be used to detect shocks, lighting conditions, proximity to other objects, or the like. The signals generated by these detectors will be used to trigger corresponding events during certain motion profile cycles.

Figure 4:
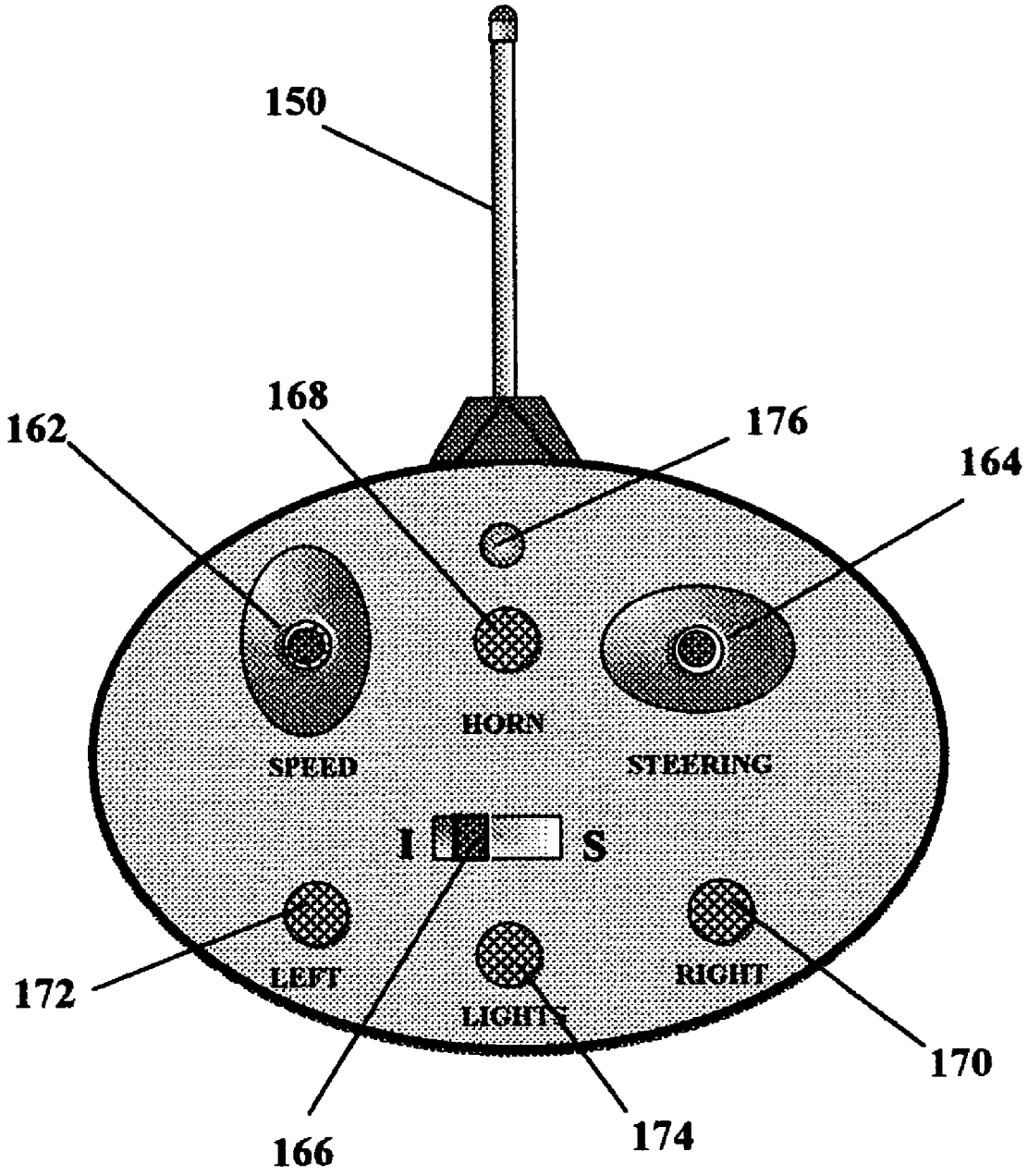
FIG. 4 is a view of the remote control apparatus showing the various control switches according to the invention.

Further, the front seat compartment includes a seatbelt 110 with an electrical connector 36 that can be plugged into an action FIG. 4. For the preferred embodiment this connector includes four pins. One of the four pins is identified as the battery pin (B pin), and provides electrical energy from the battery of the toy car apparatus to the action FIG. 4. The remaining three pins (1, 2 & 3) are referred to as identification pins, and are used to identify the action FIG. 4 to the car apparatus 10. Since each of the three pins can be either energized ("1"), or de-energized ("0"), the three pins can provide up to eight different binary identifications: 000, 001, 010, 011, 100, 101, 110 & 111. However, in order to detect that an action FIG. 4 has been connected to the seatbelt 110, the "000" binary identification is not used. Accordingly, the preferred embodiment can employ up to seven (7) different action figures. It should be noted that the use of a hard-wired connector to link an action FIG. 4 to the toy apparatus 10 is being disclosed for the purpose of describing the preferred embodiment, and is not intended to limit the present invention. As would be appreciated by a person of ordinary skills in the art, other means to link an action FIG. 4 to the toy vehicle apparatus 10 can be used. For example, each action figure can include a barcode that is read by the car apparatus to identify the action figure. Alternatively, infrared or magnetic modules can be used to transmit the identity of an action figure to the car device. Further, a connector with a larger, or smaller, number of pins can be used. Obviously, for the preferred embodiment, the number of pins will determine the maximum number of action figures that can be employed with the invention. For example, if five (5) pins are used, the play set will provide identifications for fifteen (15) action figures.

Figure 3:
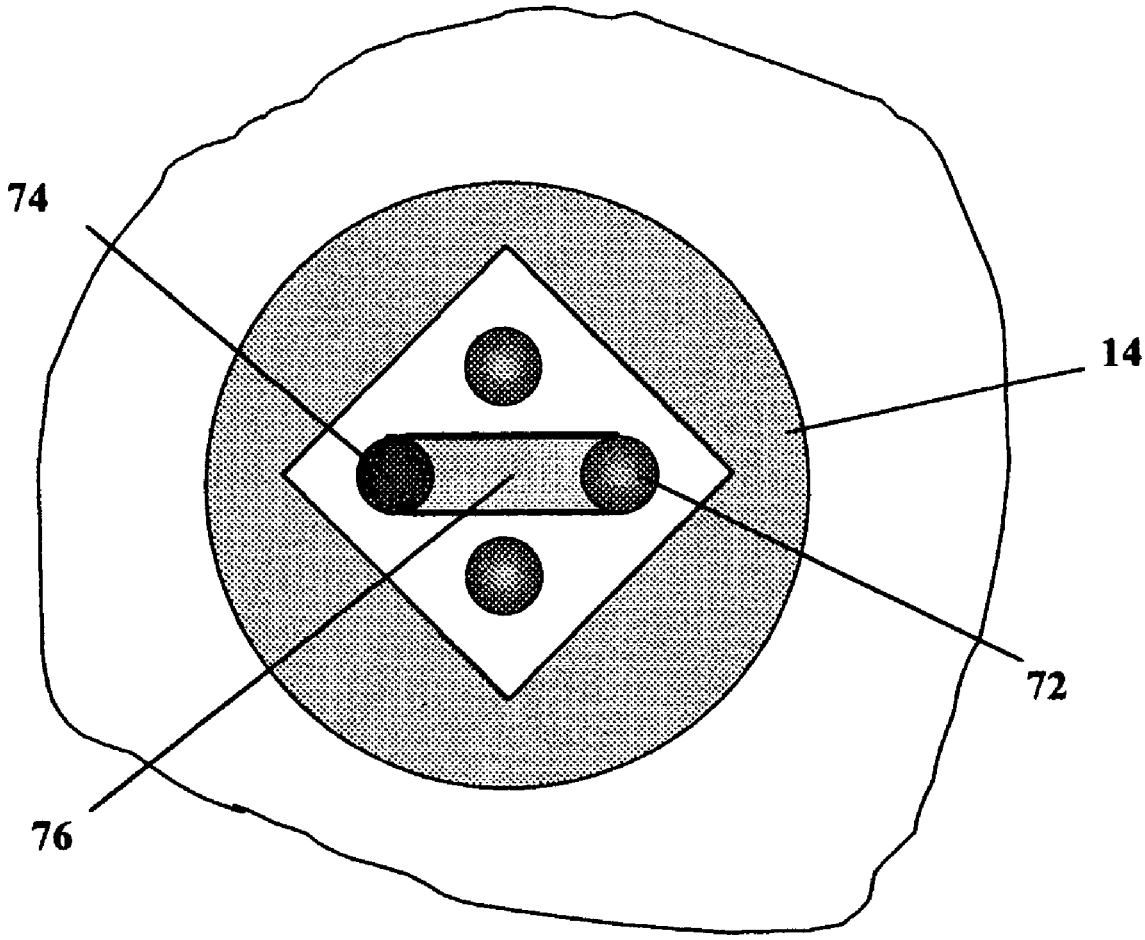
FIG. 3 is a diagram showing an electrical jumper within an action figure.

In order to implement the above described binary identification scheme, and as indicated in FIG. 3, each action figure includes one, or a plurality of electrical jumpers 112, which connect the battery pin to the identification pins. The various configurations of these jumpers are shown in FIG. 11. It should be noted that the use of a plurality of action figures to implement the present invention is not necessary. As would be appreciated by a person of ordinary skills in the art, a single action figure with removable, or switchable, jumpers can be used to offer the same functionality provided by seven action figures. This is achievable by enabling the player to modify the identity of the action figure through the use of a plurality of dip (micro) switches, a selector switch, or the like. In such an alternate embodiment, a player can "program" the action figure, to assume different identities, by simply changing the jumper configuration, or operating a selector switch. The player is also provided with a plurality of accessories to change the appearance, clothing, etc., of the action figure. The visual appearance of the action figure is coordinated with its personality profile. As part of the written instructions for this toy apparatus, the player is provided with a description of the various personality profiles, and the corresponding visual appearances.

For the preferred embodiment, the controls for the toy car are located on a remote control apparatus that communicate with the toy car using infrared (IR), or radio frequency (RF) modules. FIG. 4 provides an example of such remote control apparatus, which has a plurality of controls that include conventional functions such as speed, directional, and steering controls. The remote control apparatus may also include controls to turn the headlights 26 "on" and "off:" activate the turn signal indications 28 & 30, or to activate the horn. Further, the remote control apparatus includes a two-position switch 166 that transfers the control of the toy car from the player to the control program stored in the memory of the microprocessor. When the switch 166 is set to a first position referred to as the "I" position ("instructor" position), the remote control toy car operates as a conventional toy where the player directly controls the operating functions of the car. Under the "instructor" setting, the player may use the speed, directional, and steering controls 162 & 164 to operate the vehicle.

Alternatively, when the switch is set to the second position, referred to as the "S" position ("student" position), the control program stored in ROM 62 directly controls the speed, directional, steering, and other functions of the vehicle. The control program includes a plurality of motion profile cycles, each of which is associated with an action figure identity. Upon the activation of the control switch to the "student" position, and if an action figure is connected to the seatbelt 36, the microprocessor will read the identity of the action figure, and fetch the motion profile cycle data corresponding to that action figure from ROM 62. Then upon the activation of any control on the remote control apparatus, to signal that the student (action figure) is ready to drive the vehicle, the microprocessor will execute a program segment that controls the movement of the car using said motion profile cycle data. At any time during the execution of the motion profile program segment, the player can activate the control switch on the remote control apparatus to regain control of the vehicle.

A motion profile cycle consists of a series of motion command signals, which are generated as a function of time. Time "zero" is defined as the point in time when a switch is activated on the remote control apparatus to begin the execution of the motion profile cycle. Alternatively, a motion profile cycle can be based on motion commands that are generated as a function of distance traveled. In such case, the control program will use the distance information received from the motion sensor 34 to trigger the motion command signals, and other events such as audible and visual effects.

The motion command signals include acceleration, speed, directional, steering, and braking signals that would result in a desired pattern of movements. Also, overlaid on the motion commands are sound effects that correspond to the various elements of the motion profile. For example, upon the commencement of the motion profile cycle, and before the movement of the car, the microprocessor will generate a sound effect simulating turning the engine on. Also, prior to executing a steering command, the microprocessor may activate the appropriate turn signal lights 28 & 30. Further, the microprocessor will generate a braking sound effect to coincide with an abrupt stopping of the vehicle. The coordination of sound and visual effects with elements of a motion profile is dependent on the driving attributes of the associated action figure. For example, if an action figure has a habit of not activating the turn signal lights prior to making a turn, said lights will not be activated. Additional effects may include turning, or flashing, the headlights "on" and "off" 26, generating a sound to simulate the activation of a horn, activating emergency or brake indications, generating a verbal communication requesting the student to slow down, obey driving rules, or the like.

It should be noted that the use of a remote control apparatus is disclosed solely for describing the preferred embodiment. As would be appreciated by a person of ordinary skills in the art, the action figure can interact in the same manner described herein with a battery operated motorized toy vehicle. A remote control apparatus is not necessary for the basic functionality provided by the present invention. Further, the toy vehicle itself can take any of a plurality of shapes or forms. For example, the host toy device could have the shape of passenger vehicle, a van, a truck, an emergency vehicle such as a police car, a fire truck, or an ambulance, a motorcycle, or a military vehicle such as a personnel carrier, a tank or the like.

A block diagram of the control circuitry for the host car device 10 is illustrated in FIG. 5. This control circuitry includes a central processing unit 60 having a control program memory 62 associated therewith, a read only memory (ROM), a FLASH memory 66, a random access memory (RAM) 64, an interface and coding device 38, and audio interface and control circuits (audio driver) 40. The interface and coding device 38 is used as input interface between the motion sensor 34, the decoders 54, 56 & 58 associated with the communication receiver module 52, and the central processing unit 60. In contrast, the memory decoder driver 42 is used as an output interface between the central processing unit 60 and the headlights LEDs 26, left turn LEDS 28, and right turn LEDs 30. Similarly, the audio driver 40 is used as output interface between the central processing unit 60 and the loudspeaker 32. A common address and control bus 92, and a separate common data bus 90 are used to interconnect the central process unit 60 with the interface and coding device 38, the D/A converters 22 & 24, the memory decoder driver 42, the audio driver 40, the read only memory (ROM) 62, the random access memory (RAM) 64, and the flash memory 66.

It should be noted that the above description of the control circuit of the device is provided as an example for illustration purposes only, and is not intended to limit the present invention. As would be obvious to those skilled in the art, a toy designer would most likely select a micro-controller with built-in audio driver to control the host toy car device. Such micro-controller may include A/D converters, I/O ports that can be configured as input or output ports, and an audio driver. The I/O ports of the micro-controller can be used to connect the various input and output devices directly to the micro-controller without the need for any interface and coding devices or memory decoder drivers. Such micro-controllers are well known to those skilled in the art.

The central processing unit 60 controls the flow of all information throughout the entire car device under the direction of the control program. The control program resides in the read only memory (ROM) 62. A plurality of dry cell batteries 82 is positioned beneath the car seats. These batteries 82 are fed to power control circuits 86, which is controlled by an ON/OFF switch 16. The power control circuits provides power to the central processing unit 60, the LEDs for the headlights 26, and the turn signal lights 28 & 30, the servo controls 18 & 20, the electric motor, as well as to the battery pin (B) of the seatbelt connector 36.

Figure 6:
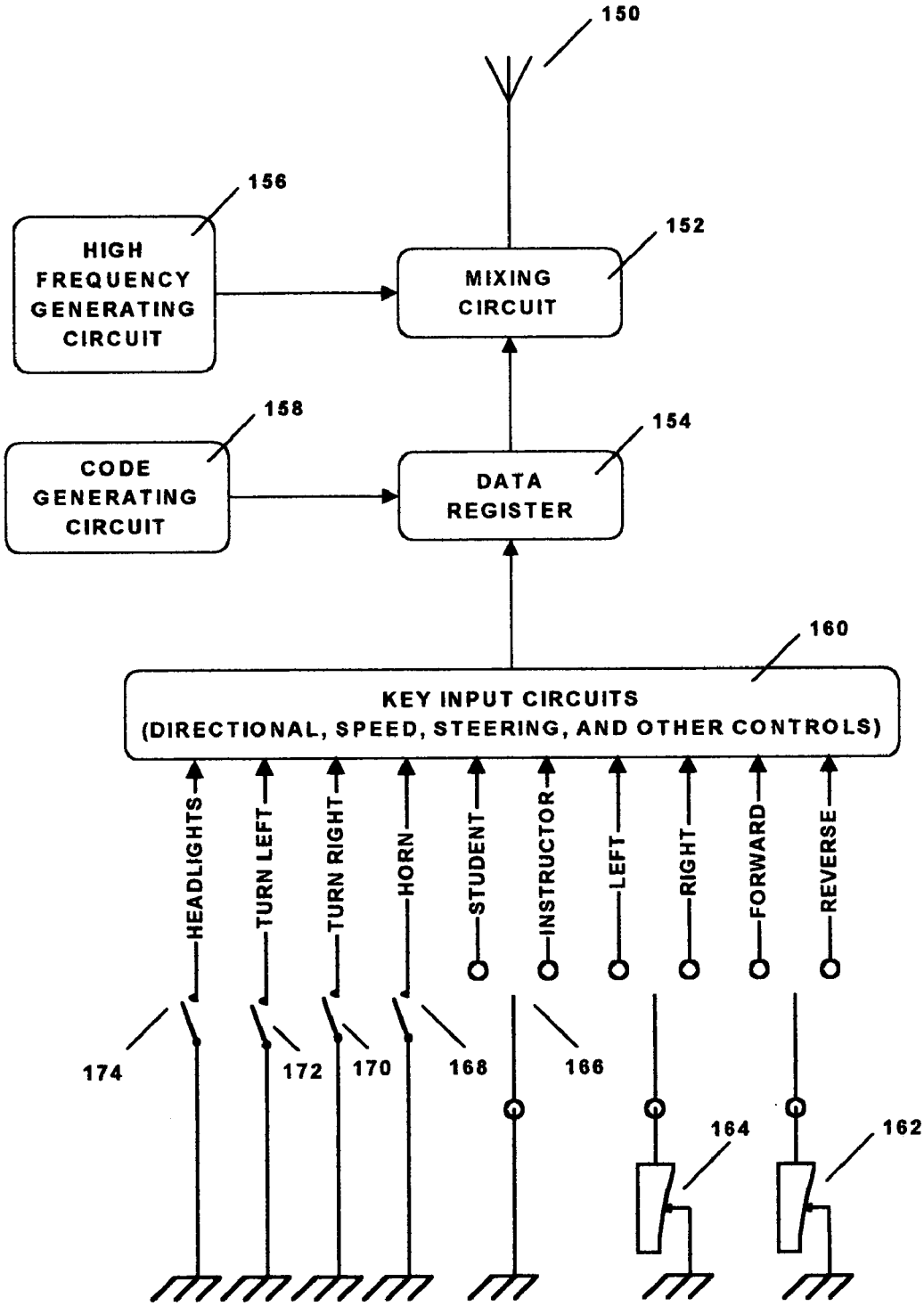
FIG. 6 is a block diagram of a transmitter module used to transmit control signals from the remote control apparatus to the toy vehicle device.

A block diagram for the transmitter module is shown in FIG. 6. The preferred embodiment employs radio frequency (RF) communication to send control data from the remote control apparatus to the car toy device. As would be appreciated by a person of ordinary skills in the art, a transmitter module includes the key input circuits 160 for the various control functions 162, 164, 166, 168, 170, 172 & 174, a high frequency generating circuit 156, code generating circuit 158, data register 154, and mixing circuits 152, to modulate the control signals.

Figure 7:
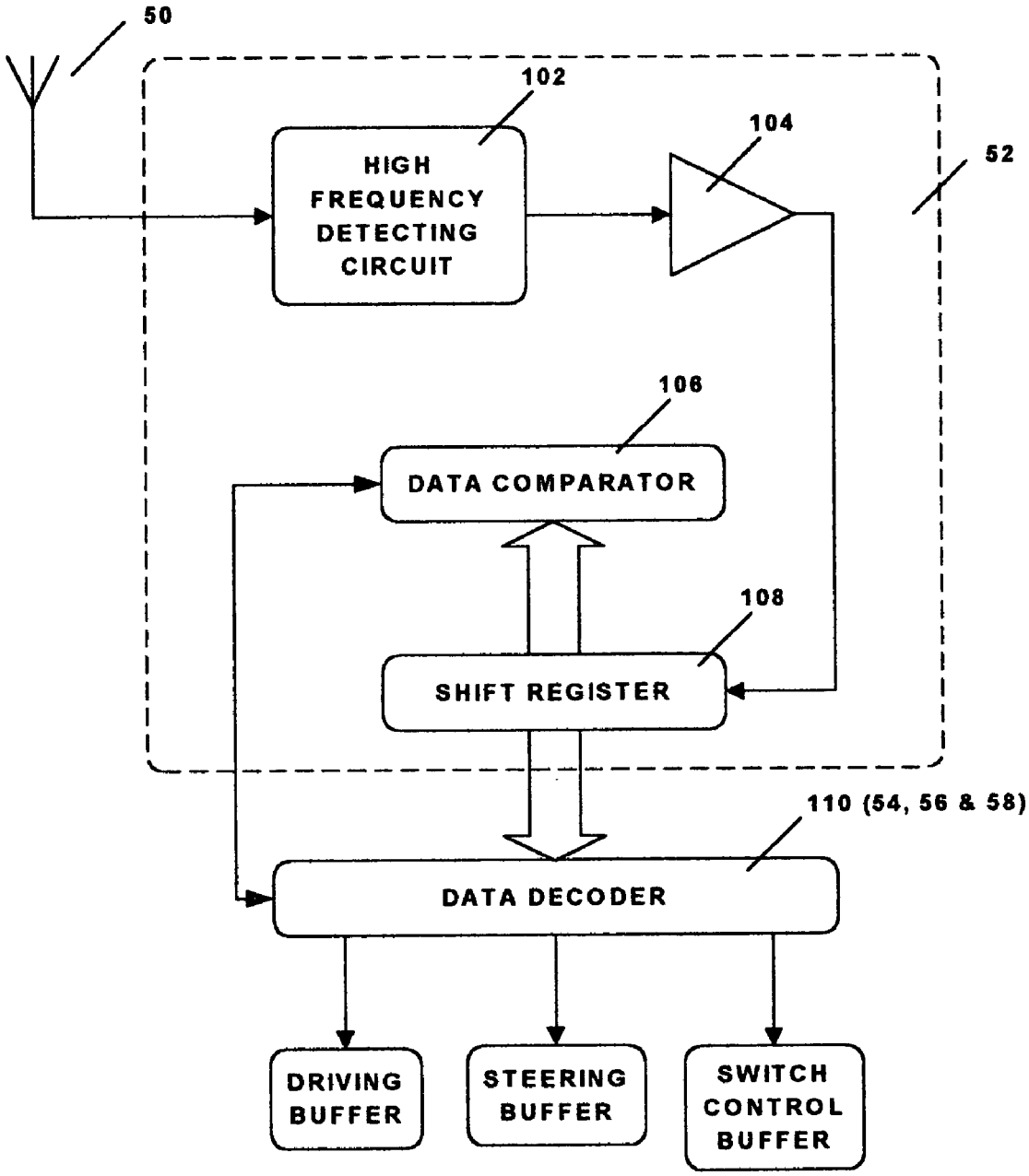
FIG. 7 is a block diagram of a receiver module located in the toy vehicle device.

Similarly, a block diagram of the receiver module is shown in FIG. 7, and includes a high frequency detecting circuit 102, and other elements 104, 106, 108 & 110 to demodulate the received signals, and extract speed, direction, steering, and other control signals.

Figure 8:
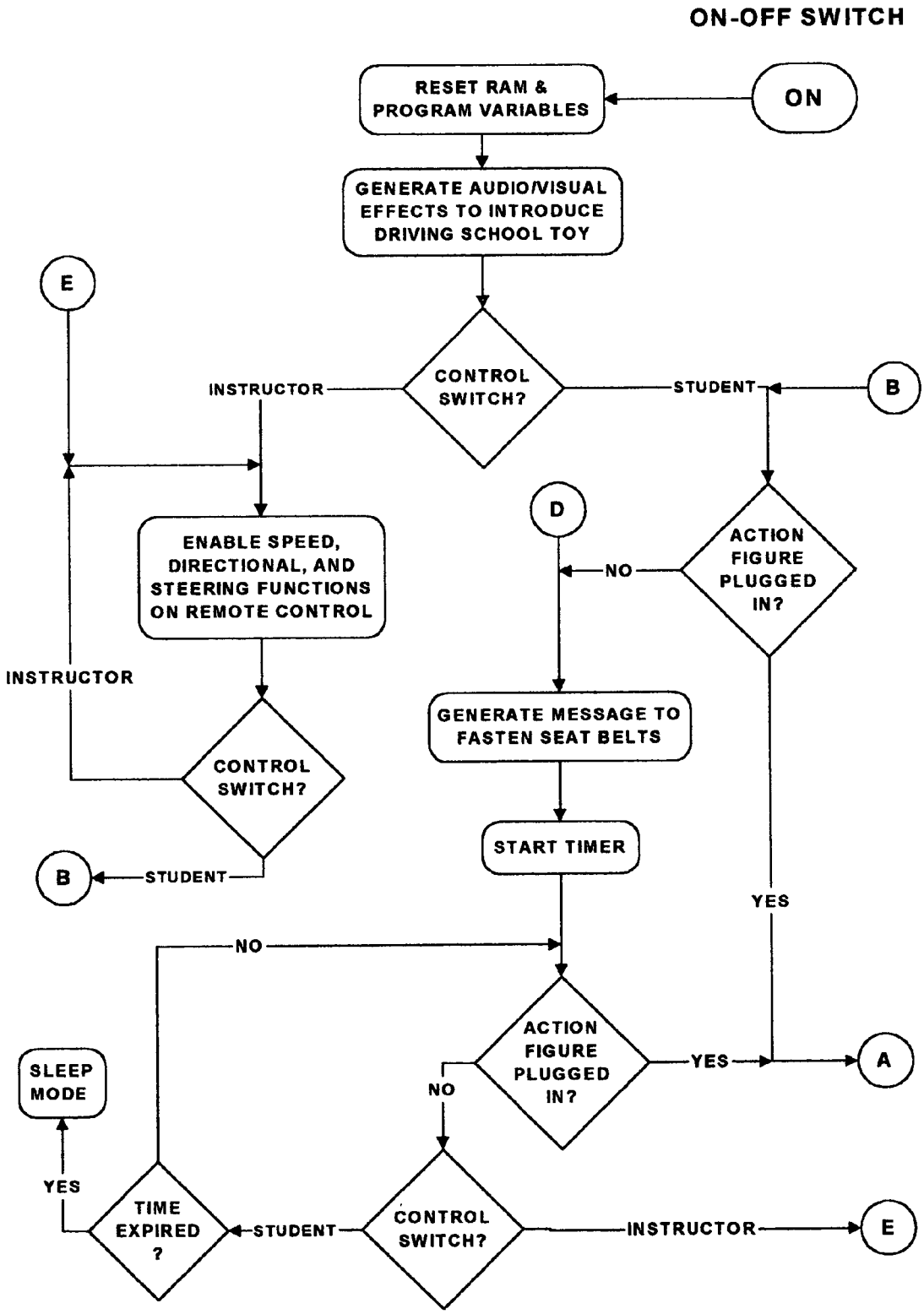
FIGS. 8-10 is a logical flow diagram illustrating the main program functions performed by the microprocessor controlling the remote control vehicle according to the invention.
Figure 9:
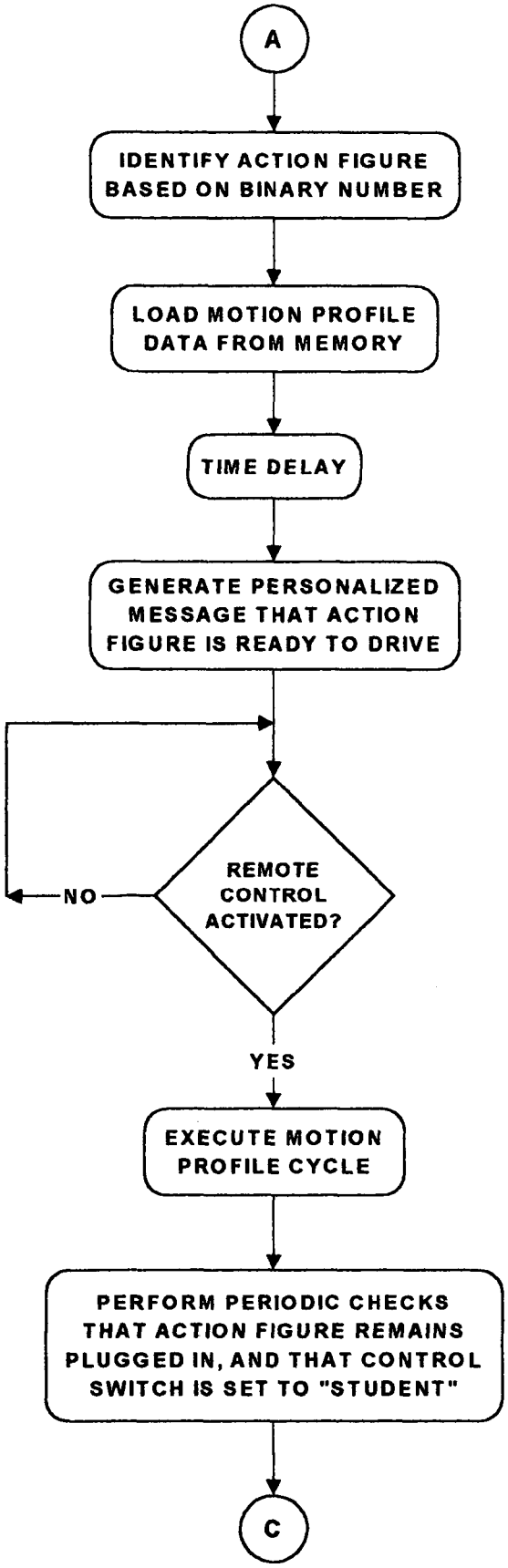
Figure 10:
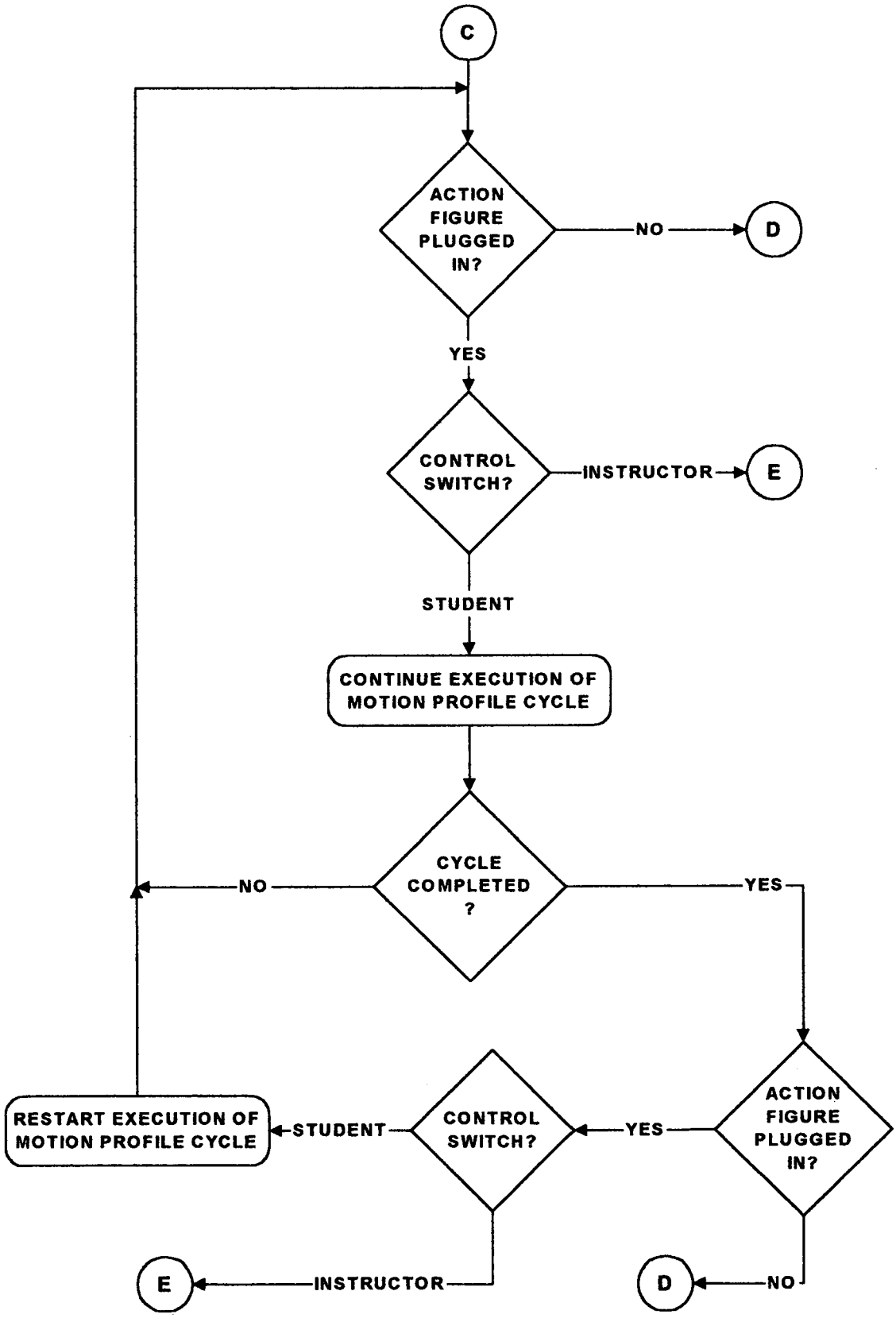

With respect to the operation of this interactive play set, the logic steps utilized for the preferred embodiment are illustrated in flow diagram form in FIGS. 8 through 10, which interconnect with each other at the places shown in the various figures. Even though specific reference will not be made to this diagram in the following description of the operation of the device, periodic reference to this diagram may prove to be helpful to the reader hereof.

Referring again to FIG. 5, in order to operate the play set, the player moves the off-on switch 16, located on the car device 10, from the "off" position to the "on" position which causes power to be supplied to all terminals of the car device 10, and which causes a pulse generator 84 to generate a reset pulse. The activation of the off-on switch, also, causes power to be supplied to the battery pin (B) of the seatbelt connector 36. The reset pulse is applied to the central processing unit 60 and causes the central processing unit 60 to clear any data remaining in the RAM 64 and in the audio driver 40 over the common data bus 90. The pulse also causes the central processing unit 60 to generate audio/visual effects that introduce the interactive play set to the player. The preferred embodiment describes a play set that is referred to as a "driving school," where the player is the instructor, and the action figures are portrayed as students. After the completion of the introduction, the control program checks the position of the control switch. The status of this switch is transmitted from the remote control apparatus, and is stored in RAM 64. If the switch is set to the "instructor" position, then the player can operate the remote control car using the speed, directional, and steering controls. located on the remote control apparatus. This mode of operation, which is referred to as the "instructor" mode, is similar to the operation of a conventional remote control toy car, and is not affected by the presence or absence of an action figure that would be plugged into the seat belt connector 36. The play set will remain in this mode of operation as long as the control switch is set to the "instructor" position. Periodically the control program will check the position of said switch to determine if it was activated by the player.

Upon the activation of the control switch to the "student" position, the microprocessor, under the direction of the control program, will ignore the speed, directional, steering, and other commands received from the remote control apparatus. However, the control program will still detect the activation of any switch on the remote control apparatus. This detection function is used to initiate a motion profile cycle associated with an action figure. The control program will next check if an action FIG. 4 is plugged into the seat belt connector 36. If no action figure is connected, the control program will generate a message for a student to fasten his or her seatbelt. The microprocessor will then await an action by the player to connect and place an action figure in the car device. The seat belt message may be repeated a number of times, however, if after the expiration of a predetermined period of time, no action figure is connected into the seat belt connector, the car device will go to a sleep mode.

Alternatively, if an action FIG. 4 is plugged into the seat belt connector 36, the control program will identify the action figure based on the binary number read through the identification pins (1, 2 & 3) of the seat belt connector 36. The control program will then select a motion profile associated with that action figure, and load corresponding data into RAM 64. After the expiration of a time delay to allow the player to place the car device on the ground, the microprocessor will generate a voice message personalized to the action figure, and indicating that the student is ready to proceed with the driving lesson, i.e., ready to drive the car. The control program will then await a signal from the instructor (the player) before executing the selected motion profile. The player can then activate any control on the remote control apparatus (with the exception of the control switch) in order to generate such signal. As an alternate to the time delay, a sensor may be used to provide an indication that the car device has been placed on the ground.

Upon receiving said signal from the player, the microprocessor will generate directional, speed and steering commands based on the data stored in RAM 64, and at intervals defined by the motion profile. The microprocessor will also generate sound and visual signals, as defined by the motion profile, and at the time or distance intervals specified in the profile. The microprocessor will continue to execute the stored motion commands until the completion of the motion profile cycle. If the control switch remains in the "student" position, and the same action figure remains plugged in, the control program will repeat the motion profile cycle. An option to the preferred embodiment will provide a plurality of motion profiles for each action figure. Under such option, upon the expiration of a motion profile cycle, the control program will select a different motion profile for the same action figure, and will execute said motion profile, in the same manner, using the new data stored in RAM 64. At any time during The execution of a motion profile cycle, the player can regain control of the car device, by activating the control switch to the "instructor" position.

A typical motion profile cycle is shown in FIGS. 12, 13, 14 & 15. The first graph shown in FIG. 12 indicates the direction and speed signals as a function of time. The graph has an "X" axis that represents time, and a "Y" axis that represents the relative strength of the speed signal. For the preferred embodiment, the duration of a motion profile cycle is set at sixty (60) seconds. Obviously, longer or shorter cycle durations may be used: A positive speed signal indicates a forward movement, and a negative speed signal indicates a reverse signal. Further, the amplitude of the speed signal is measured relative to a maximum strength signal. For example, an amplitude of 0.25 is equivalent to a setting of 25% of the maximum speed setting of the servo mechanism. A 100% setting provides the maximum speed.

Figure 13:
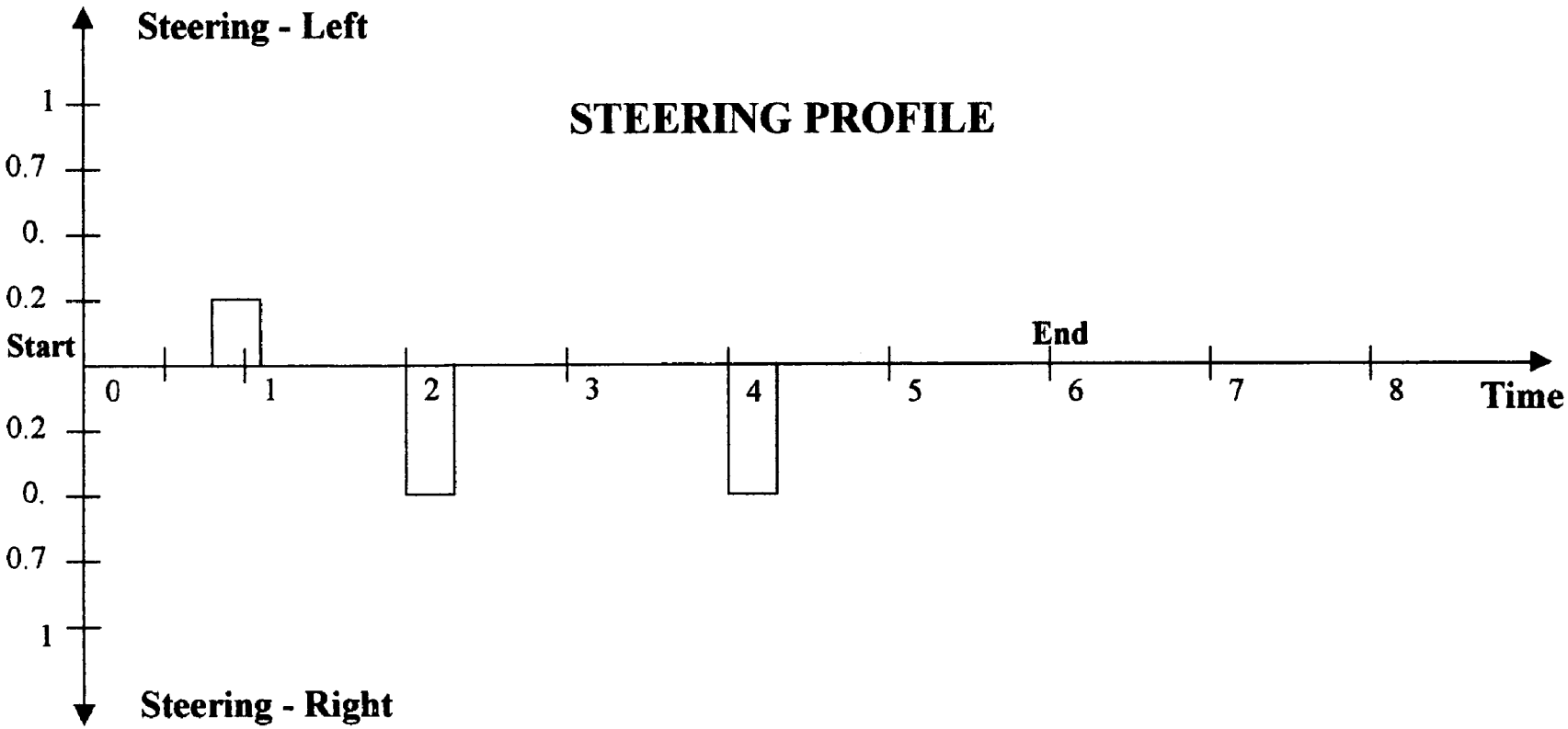
FIG. 13 indicates steering data, as a function of time, for the sample motion profile cycle.

Similarly the graph shown in FIG. 13 indicates the steering signal as a function of time. The graph has an "X" axis that represents time, and a "Y" axis that represents the relative strength of the steering signal. A positive steering signal indicates a left turn, and a negative steering signal indicates a right turn. A zero signal indicates a movement in a straight line, provided that a speed signal exists. The amplitude of the steering signal is measured relative to the maximum setting of the servo mechanism. For example an amplitude of 0.75 is equivalent to a 75% setting of the servo mechanism. A 100% setting provides the sharpest left or right turn.

Figure 12:
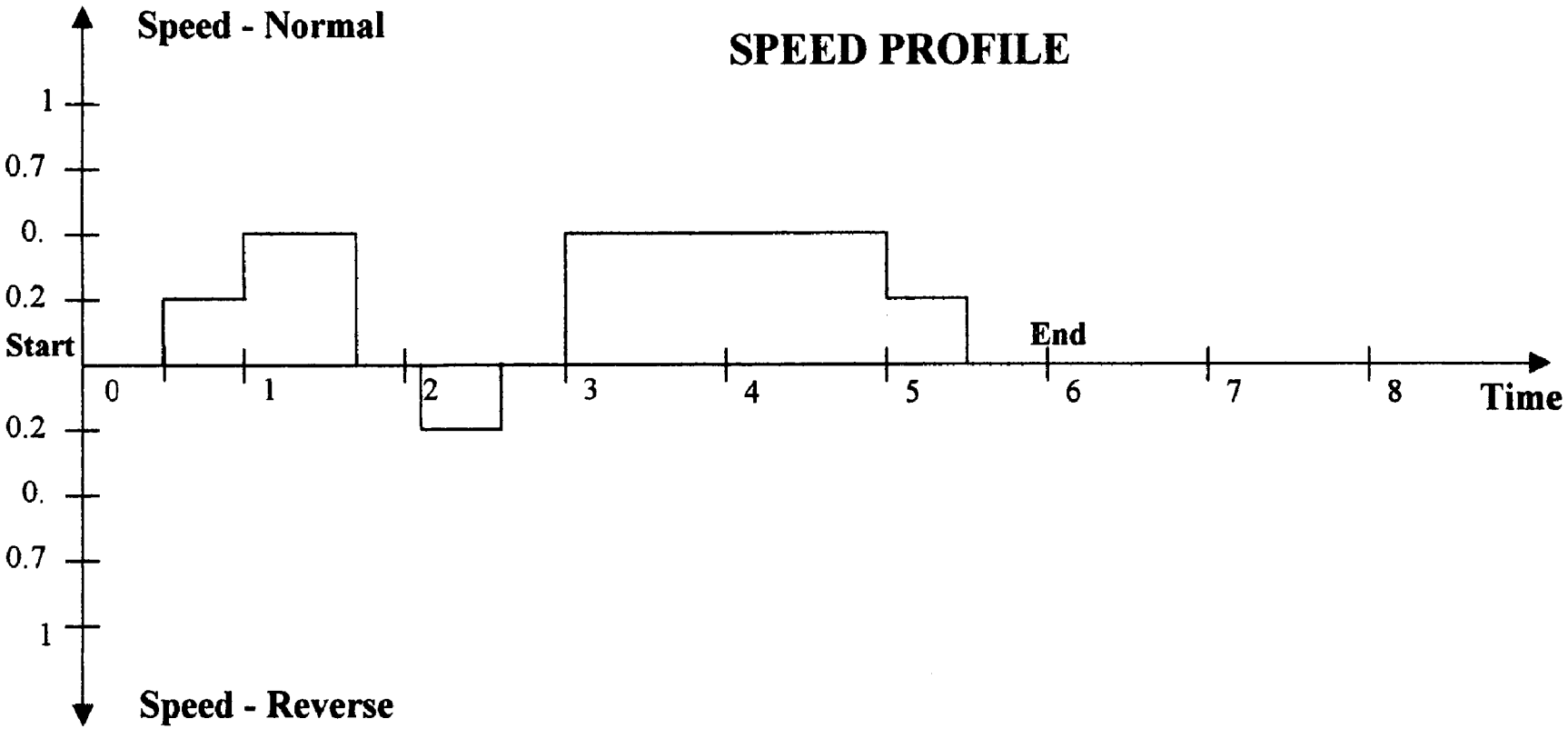
FIG. 12 indicates speed and direction data, as a function of time, for a sample motion profile cycle.
Figure 14:
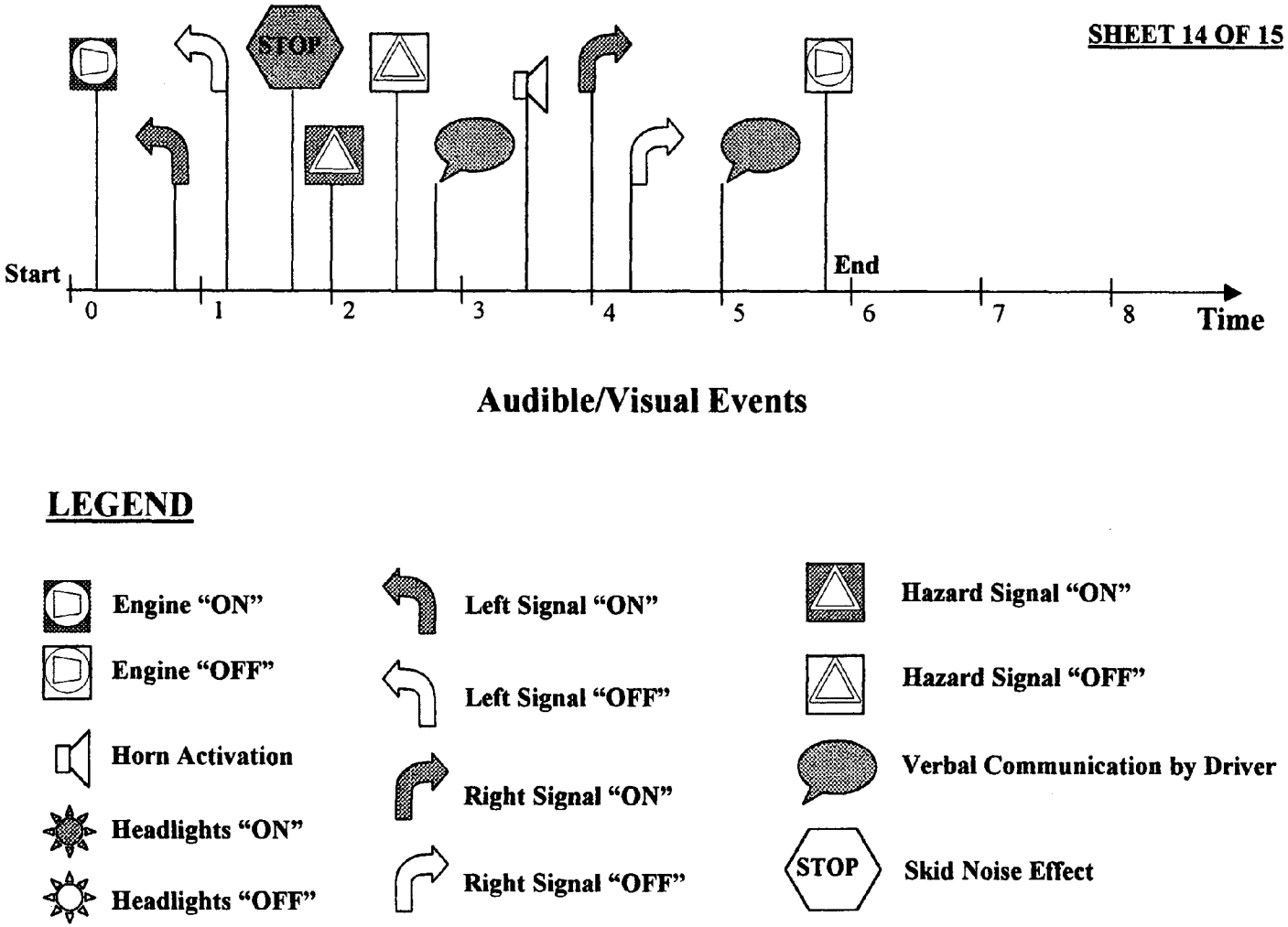
FIG. 14 shows an event diagram associated with the sample motion profile cycle of FIGS. 12 & 13, and indicating various audible and visual effects generated as a function of time.
Figure 15:
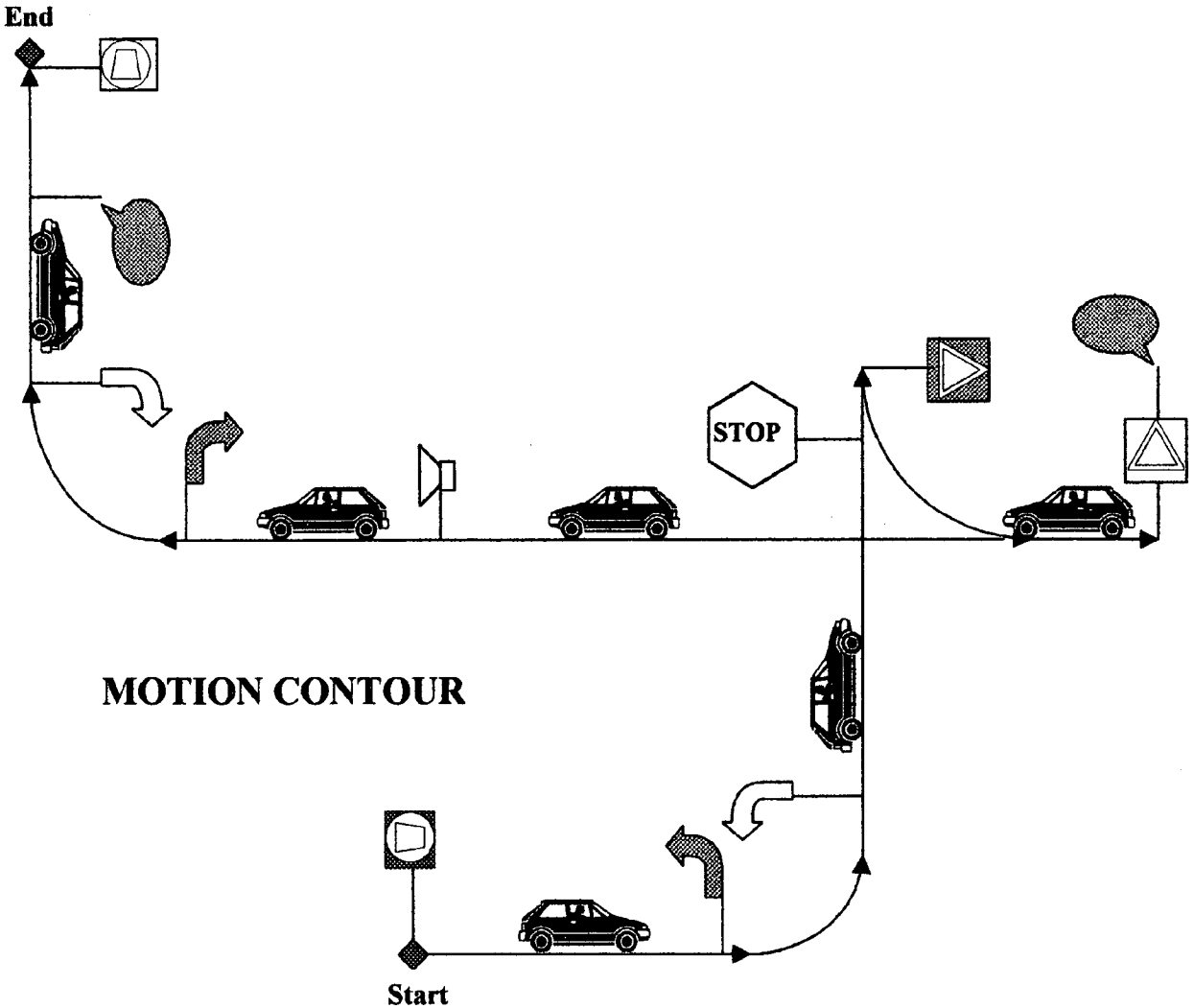
FIG. 15 is a motion contour associated with FIGS. 12, 13 & 14, indicating a two-dimensional outline of the vehicle movements, and the various audible and visual effects as a function of distance traveled.

FIG. 14 shows a graph that indicates the audible and visual events associated with the motion profile described in FIGS. 12 & 13, as a function of time. A legend for the various events is provided. The graph provides the timing of activating and deactivating certain functions, such as headlights, turn signal lights, or hazard indications. Certain functions of short duration, such as a skid noise indication, or a horn indication, only have an activation time setting. FIG. 15 shows the motion contour corresponding to FIGS. 12, 13 & 14. This graph indicates the actual movements of the toy car device (not to scale) in a two-dimensional configuration. The graph also indicates the locations where the various audible and visual events take place using the legend described in FIG. 14.

It should be noted that the use of a toy vehicle herein is only for the purpose of describing the preferred embodiment, and is not intended to limit the invention hereto. An alternate embodiment may use a doll in the shape of a child as the host toy. In such case, the action figures are depicted as a plurality of pets that include a dog, a cat, a horse, a bird, or the like. Some of these action figures could be mechanized, and include a control mechanism responsive to signals received from the doll device. Such mechanized pet animals are well known in the art. Also, each action figure has a unique identification, and is capable of performing certain acts. For example a dog action figure is capable of producing a "barking" sound effect, and could include mechanical parts that enables it to move its tail, and fold its rear legs. Similar actions responsive to requests or commands by the doll device are provided by the remaining action figures.

The doll host toy device includes an input control mechanism to enable a player to interact with it. The doll also includes a leach that is used as a connector, and can be attached to an animal's neck. Similar to the car device, the doll interacts with each of the action figures in a predetermined manner. The doll includes a microprocessor, and a control program stored in its Read Only Memory (ROM). Upon connecting an action figure to the leach connector, the microprocessor identifies the action figure, and executes a control program segment to initiate and control the interactions between the doll device and said action figure. These interactions may include verbal statements, requests, or commands from the doll device, followed by responses by the action figure. For example, the doll device can command a dog to sit, bark, or wiggle its tail, and the dog device will comply with these commands using signals received from the doll device. In such play set, the functionality of the host toy, i.e. the specific interactions generated by the doll, is dependent on which action figure is connected to the doll. Further, an action figure's response is controlled by signals received from the doll device.

It should be noted that the description of a leach to interconnect the doll device with a pet animal action figure is for the purpose of describing the alternate embodiment, and is not intended to limit the scope of this invention. As would be appreciated by a person of ordinary skills in the art, other means of communication could be used to communicate or exchange information between the doll device and a pet animal action figure. For example, radio frequency (RF) communication, infrared (IR) communication, or magnetic coupling devices could be used to enable the doll device to identify an action figure and communicate with it.

Further, as will be understood by those skilled in the art, additional alternate embodiments may be based on different host toys, and action figures. For example, other action figures may include fictitious or cartoon characters, national heroes, movie characters, TV personalities or the like. Further, the logical flow diagram shown in FIGS. 8 to 10 is only one example of how to implement the new general concept of a host toy interacting with a plurality of action figures. A person of ordinary skills in the art will appreciate that alternate programs may be utilized to implement this flow diagram. Obviously these programs will vary from one another in some degree. However, it is well within the skill of the computer programmer to provide particular programs for implementing each of the steps of the flow diagrams disclosed herein. It is also to be understood that the foregoing detailed description has been given for clearness of understanding only, and is intended to be exemplary of the invention while not limiting the invention to the exact embodiment shown. Obviously certain subsets, modifications, simplifications, variations and improvements will occur to those skilled in the art upon reading the foregoing. It is, therefore, to be understood that all such modifications, simplifications, variations and improvements have been deleted herein for the sake of conciseness and readability, but are properly within the scope and spirit of the following claims.

The invention claimed is:

1. A play set comprising:

a toy vehicle and a plurality of action figures, wherein action figures interact with the vehicle, wherein each action figure is defined by a plurality of attributes, wherein an action figure has at least one attribute that affects the manner in which it interacts with the vehicle, and wherein at least one action figure has at least one unique attribute that distinguishes it from other action figures, memory storage means for storing action figure attributes data, a microprocessor with a computer-readable medium encoded with a computer program that controls the operation of the vehicle, means for identifying an action figure to the vehicle, means for providing a plurality of vehicle actions, wherein at least one of said vehicle actions is based on an attribute data stored in memory, and a computer program segment that selects and executes an interaction for the vehicle based on the identity of the action figure interacting with the vehicle.

2. A play set as recited in claim 1 further comprising a plurality of input control mechanisms to enable a user to interact with the vehicle.

3. A play set as recited in claim 2, wherein said plurality of input control mechanisms are located on a remote control apparatus, and wherein one of said plurality of input control mechanisms controls when an action figure interacts with the vehicle.

4. A play set as recited in claim 1 further comprising means for generating at least one of visual effects and sound effects, which are coordinated with the actions of the toy vehicle.

5. A play set as recited in claim 1 wherein said plurality of action figures is provided by a single action figure that includes an input control mechanism, or a selector switch, to enable a user to change the identity and attributes of the action figure.

6. A play set as recited in claim 1 further comprising a remote control apparatus, wherein said plurality of action figures are depicted as student drivers, and wherein said attributes include human like driving habits attributes.

7. A play set as recited in claim 1, wherein said plurality of interactions include at least one motion profile for the vehicle that is based on a driving habit attribute of a specific action figure.

8. A play set as recited in claim 7, further comprising means for generating a plurality of audible or visual effects that are coordinated or synchronized with said motion profile.

9. A play set comprising:

a toy vehicle and a plurality of action figures, wherein action figures interact with the vehicle, wherein each action figure is defined by a plurality of attributes, wherein an action figure has at least one attribute that affects the manner in which it interacts with the vehicle, and wherein at least one action figure has at least one unique attribute that distinguishes it from other action figures, non-volatile memory to store action figure attributes data;

a microprocessor with a computer-readable medium encoded with a computer program to control the functionality of the vehicle, a communication link between the vehicle and an action figure, a data section of said computer program to store data for a plurality of vehicle actions wherein at least one of said vehicle actions includes a motion profile, and a computer program segment that selects and executes a vehicle action based on a stored attribute of the action figure communicating with the vehicle.

10. A play set as recited in claim 9 wherein the communication link includes at least one of hard wired connection, radio frequency identification, infrared transmitter/receiver, radio frequency transmitter/receiver, and magnetic coupling modules.

11. A play set as recited in claim 9, wherein the action figures are depicted as drivers, wherein said motion profile is based on a stored attribute of the action figure communicating with the vehicle attributes mimic human like behavior, and wherein said.

12. A play set as recited in claim 9 wherein said plurality of action figures is provided by a single action figure having an input control mechanism, or a selector switch, to enable a user to select one of a plurality of identities and associated attributes for the action figure.

13. A play set as recited in claim 9 wherein the shape of the vehicle is in the form of a car, a military vehicle, a rescue vehicle, a bus, a motorcycle, a boat, a plane, or an action character vehicle.

14. A play set as recited in claim 9 further comprising a remote control apparatus having a plurality of switches to control the operation of the toy vehicle, and wherein one of said plurality of switches controls when an action figure interacts with the vehicle.

15. A play set as recited in claim 9 further comprising means for programming and storing a plurality of vehicle actions that are triggered in future play sessions by stored attributes of action figures, and wherein said plurality of vehicle actions include at least one motion profile that is based on a human like driving habit of an action figure.

16. A play set comprising:

a toy vehicle and a plurality of action figures, wherein action figures interact with the vehicle, wherein each action figure is defined by a plurality of attributes, wherein an action figure has at least one attribute that affects the manner in which the action figure interacts with the vehicle, and wherein at least one action figure has at least one unique attribute that distinguishes it from other action figures, non-volatile memory to store action figure attributes data, a microprocessor with a computer-readable medium encoded with a computer program to control the functionality of the vehicle to interact with at least one of a user and an action figure, means for communicating information from an action figure to the toy vehicle, a data section in said computer program, which stores data for a plurality of motion profiles, wherein at least one motion profile is associated with a stored attribute of an action figure, a motor that is responsive to signals generated by the microprocessor during the execution of a motion profile, and a computer program segment that, upon communicating with an action figure, selects and executes a motion profile associated with a stored attribute of said action figure.

17. A play set as recited in claim 16 further comprising a remote control apparatus having a plurality of switches to enable a user to control the movement of the vehicle, and wherein one of said plurality of switches controls when a motion profiles associated with an action figure controls the movement of the vehicle.

18. A play set as recited in claim 16 further comprising means for generating at least one of audible effects and visual effects.

19. A play set as recited in claim 18 wherein said visual effects include the activation of at least one of headlights, turn signal lights, and emergency flashing lights.

20. A play set as recited in claim 18 wherein said audible effects include generating sound effects simulating the activation of at least one of a horn, skid noise caused by braking, and engine sound.

21. A play set as recited in claim 18 wherein said non-volatile memory is located in at least one of the microprocessor that controls the vehicle, and an action figure.

22. A play set as recited in claim 16, wherein the shape of the vehicle is in the form of a car, a military vehicle, a rescue vehicle, a bus, a motorcycle, a boat, a plane, or an action character vehicle.

23. A play set as recited in claim 16 further comprising a plurality of switches to enable a user to program, and store a plurality of vehicle actions that are based on stored attributes of action figures, including at least one motion profile for the vehicle that is based on a stored human like driving attribute of an action figure.

24. A play set comprising:

a toy vehicle and a plurality of action figures, wherein action figures interact with the vehicle, wherein each action figure is defined by a plurality of attributes, wherein an action figure has at least one attribute that is based on a human like driving habit, which affects the manner in which the vehicle moves, and wherein at least one action figure has at least one unique attribute that distinguishes it from other action figures, non-volatile memory to store action figure attributes data, a microprocessor with a computer-readable medium encoded with a computer program to control the functionality of the vehicle, means for communicating data from an action figure to the toy vehicle, a data section in said computer program, which includes data to provide a plurality of vehicle actions that include a plurality of motion profiles, wherein at least one of said actions is triggered by a stored attribute of an action figure, and a computer program segment that selects and executes a vehicle action based on the identity of the action figure communicating with the toy vehicle.

25. a play set as recited in claim 24 further comprising a plurality of switches to enable a user to interact with the vehicle.

26. A method for a play set that includes a toy vehicle and a plurality of action figures, wherein action figures communicate and interact with the vehicle, having the steps of:

assigning attributes to action figures, including unique attributes to distinguish action figures from each other, providing a plurality of actions for the vehicle that include at least one motion profile, and wherein at least one vehicle action is based on an attribute of an action figure, establishing communication between an action figure and the vehicle, ascertaining the attributes of the action figure communicating with the vehicle, selecting and implementing a vehicle action based on an attribute of said action figure communicating with the vehicle.

27. A method for a play set that includes a toy vehicle and a plurality of action figures, wherein action figures communicate and interact with the vehicle, and wherein the vehicle interacts with a user, having the steps of:

assigning attributes to action figures, including unique attributes to distinguish action figures from each other, providing a plurality of actions for the vehicle that include at least one motion profile, and wherein at least one action is based on an attribute of an action figure, providing at least one action for the vehicle that is programmed by the user during game play, and which is associated with a specific action figure, establishing communication between an action figure and the vehicle, ascertaining the attributes of the action figure communicating with the vehicle, selecting and implementing a vehicle action based on an attribute of said action figure communicating with the vehicle.

28. A method for a play set as recited in claim 27, wherein said unique attributes include at least one attribute that is based on a human like driving habit that affects the movement of the vehicle.

* * * * *